US012268914B2

(12) United States Patent
Young

(10) Patent No.: US 12,268,914 B2
(45) Date of Patent: Apr. 8, 2025

(54) SYSTEM AND METHOD OF ISOMETRIC EXERCISE

(71) Applicant: Joshua Young, Toronto (CA)

(72) Inventor: Joshua Young, Toronto (CA)

( * ) Notice: Subject to any disclaimer, the term of this patent is extended or adjusted under 35 U.S.C. 154(b) by 274 days.

(21) Appl. No.: 17/749,239

(22) Filed: May 20, 2022

(65) Prior Publication Data

US 2023/0405383 A1 Dec. 21, 2023

(51) Int. Cl.
*A63B 21/002* (2006.01)
*A63B 21/00* (2006.01)
*A63B 21/16* (2006.01)

(52) U.S. Cl.
CPC ..... *A63B 21/0023* (2013.01); *A63B 21/153* (2013.01); *A63B 21/16* (2013.01)

(58) Field of Classification Search
CPC ... A63B 21/0023; A63B 21/153; A63B 21/16; A63B 21/4043; A63B 2225/09; A63B 23/12; A63B 2023/006; B65H 75/4431
USPC ..... 242/385, 385.1, 385.3, 385.4
See application file for complete search history.

(56) References Cited

U.S. PATENT DOCUMENTS 3,392,477 A * 7/1968 Haugen, Jr. ..... A01K 97/06 43/57.1
3,506,262 A * 4/1970 Wade ..... A63B 21/018 482/120
3,677,551 A * 7/1972 Schaus ..... A63B 69/3608 473/208
3,708,167 A * 1/1973 Potgieter ..... A63B 21/4047 482/41
3,752,474 A * 8/1973 Macabet ..... A63B 69/18 482/131
3,885,789 A * 5/1975 Deluty ..... A63B 21/153 242/147 R
4,402,504 A * 9/1983 Christian ..... A63B 21/156 482/129
5,067,709 A * 11/1991 Christianson ..... A63B 21/154 254/398
5,289,987 A * 3/1994 Collins ..... B60R 22/44 242/385.3
6,634,995 B1 * 10/2003 Reed ..... A63B 23/0233 482/92
8,096,922 B2 * 1/2012 Planke ..... A63B 21/4019 482/7
8,152,704 B2 * 4/2012 Brice ..... A63B 21/1645 482/904

(Continued)

*Primary Examiner* — Loan B Jimenez
*Assistant Examiner* — Kathleen M Fisk
(74) *Attorney, Agent, or Firm* — Heer Law; Stephano Salani

(57) ABSTRACT

A hand-held unit that allows a user to perform, in a seated, kneeling, lying down or standing position, a variety of isometric exercises for the muscles of the trunk, upper body and lower body in 1.5 inch increments. The load is generated by the force initiated by the user and is transmitted through a 19 ft, 1.5 in wide "seatbelt grade" polyester strap with a load rating of 4000-6000 lb. The strap is folded in half and mounted to a spool that rotates when the locking pin that is mounted to the fixed outside wall is pulled and held by the user. The unit locks when the locking pin is released via spring loaded into a locking mechanism welded to the side of the spool. The looped strap can be adjusted to any needed length for a particular user and a particular exercise. The device adapts to right- or left-handed operation.

18 Claims, 4 Drawing Sheets

(56) References Cited

U.S. PATENT DOCUMENTS

| | | | | |
|---|---|---|---|---|
| 8,641,586 | B2 * | 2/2014 | Bremer | A63B 23/0211 482/121 |
| 8,882,016 | B1 * | 11/2014 | Melvin | B65H 75/4492 242/405 |
| 9,764,177 | B2 * | 9/2017 | Baudhuin | A63B 23/1209 |
| 9,868,015 | B2 * | 1/2018 | Bowles | A63B 21/0726 |
| 9,889,332 | B2 * | 2/2018 | Bowles | A63B 21/153 |
| 9,974,993 | B1 * | 5/2018 | Pollock | A63B 21/4034 |
| 10,478,662 | B2 * | 11/2019 | Davis | A63B 21/4013 |
| 10,561,880 | B2 * | 2/2020 | Pollock | A63B 23/03508 |
| 11,850,465 | B2 * | 12/2023 | Brown | A63B 21/153 |
| 2006/0201450 | A1 * | 9/2006 | Jordan | A63B 23/04 119/796 |
| 2012/0245004 | A1 * | 9/2012 | Bremer | A63B 23/14 482/129 |
| 2015/0148199 | A1 * | 5/2015 | Strickland | A61H 1/0218 482/91 |
| 2017/0259112 | A1 * | 9/2017 | Davis | A63B 21/4013 |
| 2023/0009261 | A1 * | 1/2023 | Kelly | A63B 21/0552 |
| 2023/0013107 | A1 * | 1/2023 | Momin | B66D 1/02 |
| 2023/0405383 | A1 * | 12/2023 | Young | A63B 23/12 |

* cited by examiner

SYSTEM AND METHOD OF ISOMETRIC EXERCISE

BACKGROUND

Field of Invention

The present invention or device relates generally to therapeutic and fitness procedures and devices, and more particularly to a device that allows specialised isometric exercise for the purpose of helping people safely and efficiently achieve greater joint stability and durability, improve muscular strength and power along with helping to rehabilitate and prevent injuries in addition to improving athletic performance.

Description of the Problem Solved

The application of Isometric exercise has been accepted worldwide as a safe, effective and efficient method of exercise practice throughout history.

Isometric exercise has been used as form of exercise and conditioning for the ancient armies of Rome, Greece and China as well as martial artists and athletes for centuries. The Scientific validation of Isometric exercise began post World War I in the early 1920's with the "frog experiment". Although the scientists of Springfield College made an amazing discovery regarding the comparative effectiveness of isometric vs. isotonic exercise, they failed to develop and implement a program to either help rehabilitate veterans or society at large.

In 1953, research conducted at the World renowned Max Planck Institute in Germany conclusively proved the superiority of daily isometrics in efficiently developing muscle hypertrophy and strength. By completing just one (1) set of isometric contraction for seven (7) seconds using ⅔ of maximum capacity, a person could increase their strength up to 5% per week. For the rehabilitation of injuries and those looking to achieve their fitness goals or to improve sports performance, implementing isometric exercise is a SAFE, efficient and effective method of exercise that should not be discounted.

Isometric exercise optimizes several key factors to make muscle and tendon grow stronger. "Time under tension". When stress is imposed upon a muscle and its threshold is surpassed, the human body naturally increases the size and density of the muscle and tendon fibers to meet the demands of the stress being imposed on the involved structures. The added benefit of Isometric exercise is that there is "no movement" like that involved in concentric and eccentric (isotonic) exercise which means there is "no acceleration, deceleration or shear" on the joints. For those dealing with orthopaedic injuries, arthritic issues or neurological deficiencies this means they will have to deal with substantially less stress on the joint structures while achieving optimal fitness outcomes.

Since isometric exercise doesn't involve any movement, and the load is dictated by your effort, there is NO lifting of heavy weights and objects, especially overhead. Unlike most conventional gym and fitness routines that involve lifting and moving load at varying speeds until fatigued which creates an increase in the likelihood of muscle, tendon or ligament injury in addition to possibility of dropping weights, using Isometric exercise eliminates the likelihood of injury from mishandling a heavy external load while performing maximum effort.

To maximize muscle and strength gains all three (3) muscle fiber types (slow twitch, fast twitch, intermediate/type 2B) must be optimally stimulated.

However, during conventional load bearing exercise as you move through a range of motion you typically go from a biomechanically disadvantaged to advantaged position engaging and fatiguing your intermediate/type 2 fibers long before the slow twitch and fast twitch muscle fibers. Studies have proven that conventional exercise doesn't stimulate any of the three (3) muscle fiber types very efficiently or for an extended period of time. This is why multiple sets and repetitions are required for optimal results. However, Isometric exercise is much more efficient because it engages more muscles for a substantially longer period of time. Also, during just a seven (7) second contraction, the intensity which is generated engages the intermediate/type 2 fibers almost to the point of failure.

It is these very fibers that have to be targeted for optimal muscle growth and strength.

North American Society is presently faced with a health crisis. Despite a 40 billion dollar revenue fitness industry in 2019, we have an epidemic increase in obesity, high blood pressure and diabetes in addition to an increasing aging population with a number of orthopaedic and neurological issues and needs.

With a system overburdened and making very little progress, we have to find a more efficient and effective methodology to help those in need in addition to helping to reduce the financial burden to the healthcare system.

This is where isometrics can make significant difference. In addition to maximally engaging all muscle fiber types as well as the optimal stimulation of intermediate/type 2 muscle fibers for strength and muscle growth, isometric exercise has been clinically proven to lower systolic and diastolic blood pressure in addition to mean arterial pressure. The magnitude of effect is more beneficial than that of dynamic aerobic (eg. walking, running, cycling) and resistance training while at the same time more efficient and less stressful on the joints.

As more North Americans become overweight and diabetic to due poor lifestyle choices, a cost-effective and viable treatment option for diabetic polyneuropathy needs to be implemented. Studies have shown that isometric exercise increases glucose uptake more in individuals with High vs. Normal insulin sensitivity making it not only an efficient weight-loss and strength training tool, it can help to control and maintain blood-glucose levels.

The aging population is a crisis which has a number of variables that isometric exercise has been proven to benefit. Muscular decline, balance issues which lead to falls and commonly broken bones, neurological deficiencies and diseases have all been improved with the implementation of isometric exercise. In addition to the stimulation of all muscle fiber types to build and maintain muscle, it has been shown that isometric exercise produces significantly more stress to the musculo-tendon and tendon-bone junction which helps to maintain bone density which drastically reduces the risk factors for post-fracture mortality. It has also been shown that for neurological diseases such as multiple sclerosis and Alzheimer's that isometric exercise may play an effective role in the management of vascular risk factors at the mild cognitive impairment stage.

The invention or device is a SAFE, efficient and effective portable isometric workout tool with the ability to perform thousands of therapy, general fitness or performance based exercise options in a standing, seated, kneeling or lying down position. This allows the user of any ability whether they're an elite athlete or person with physical limitations to perform and benefit from isometric exercise.

SUMMARY OF INVENTION

The present invention or device relates to the use of a hand-held unit that can be called a Portable Isometric Training Tool (PITT) that allows the user to perform, in a seated, kneeling, lying down or standing position, a variety of isometric exercises for the muscles of the trunk, upper body and lower body in approximately 1.5 inch increments. The load is generated by the force initiated by the user and is transmitted through an approximately 19 ft long, approximately 1.5 in wide "seatbelt grade" polyester strap with a load rating of approximately 4000-6000 lbs. The strap is folded in half and mounted to a spool or drum that rotates when a spring-biased locking pin, which is mounted to the fixed outside wall of the spool, is pulled and held by the user. The unit locks when the locking pin is released via the spring into a locking mechanism welded to the side of the spool.

The unique benefit of the present invention is that allows the user to safely perform countless isometric exercises with maximum effort for both the small and large muscle groups of the body in addition to being able to perform isolation (single-joint) or compound (multi-joint) exercises thereby providing the user regardless of physical ability or limitation, the opportunity to safely and efficiently perform maximal muscular effort for countless isometric exercises in a lightweight (6 lb.), compact (21 in.) unit.

This present invention allows a methodology of exercise that has been scientifically validated and proven for decades to be safe, efficient and effective. Due to its all steel construction and "seat belt" grade polyester strap, the device helps users to achieve their therapeutic, fitness and performance based exercise goals. Due to its ease of use and compact size, it can easily be used in a gym, clinic or home environment.

In summary, it is an object of the present invention to provide an isometric training device that includes a rotatable and lockable spool that can contain a wrapped strap. The spool has a pair of elongated bars attached to the spool that extend outward from the central axis on each side, where the elongated bars are used to attach the device to a fixed sur face. The device has a continuous folded double strap wrappable on the spool, where the spool and the double strap together provide a strap loop of strap length adjustable by a user. The user adjusts the strap length to obtain a continuous looped double strap of length suitable for a particular isometric exercise. There is a spring-biased retractable locking pin attached to one of the outer walls that passes through a hole that outer wall and engages a hole in the spool thus preventing it from rotating during use.

DESCRIPTION OF THE FIGURES

Attention is now directed to several drawings that illustrate features of the present invention.

FIG. 38 shows an isometric view of an assembled spool of FIG. 2A.

Several figures and illustrations have been provided to aid in understanding the present invention. The scope of the present invention is not limited to what is shown in the figures.

DESCRIPTION OF THE PREFERRED EMBODIMENTS

Figure 1:
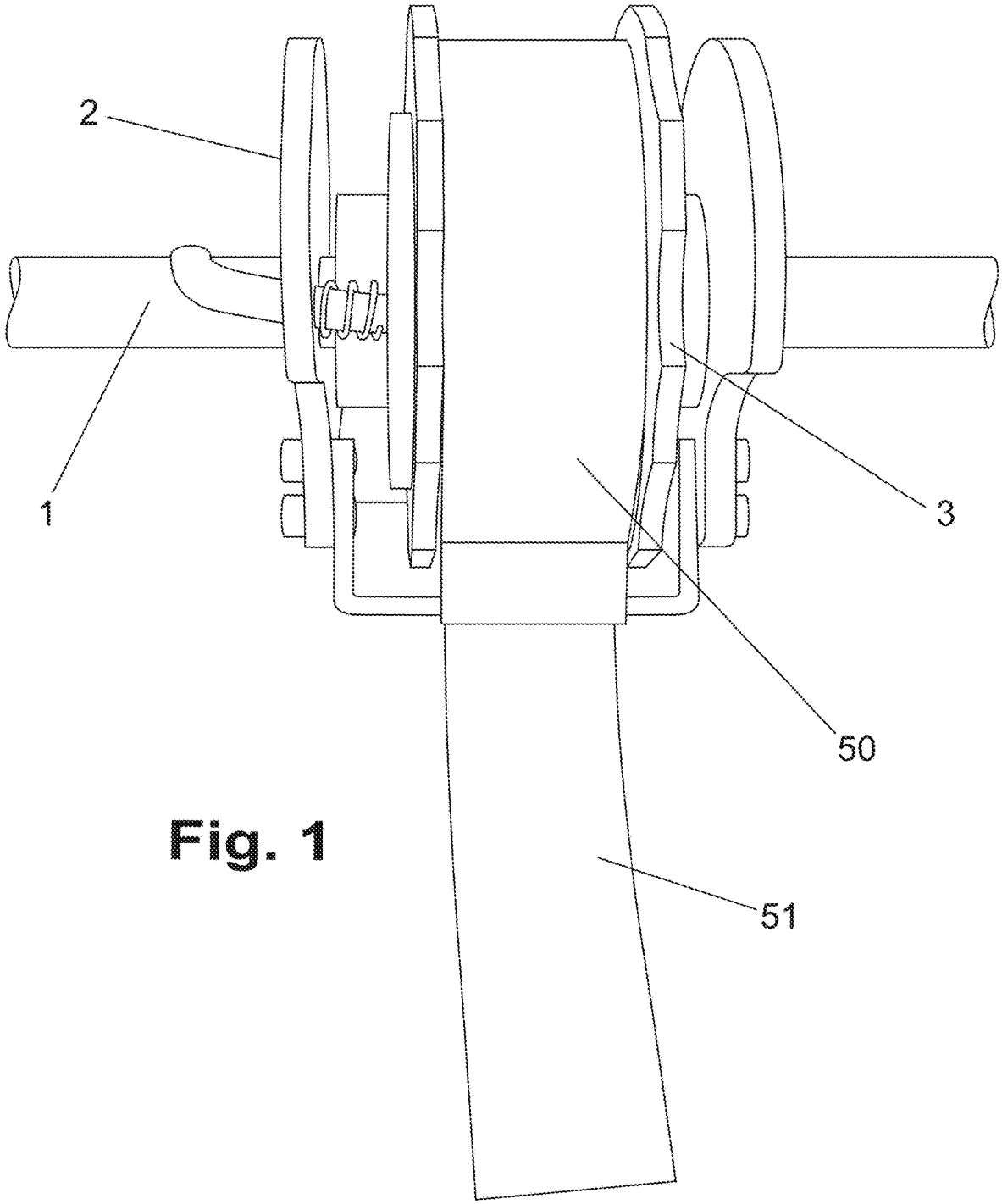
FIG. 1 shows an embodiment of the present invention.

The present invention or device is an approximately 6 lb. hand-held unit that allows the user to perform, in a seated, kneeling, lying down or standing position, a variety of isometric exercises for the muscles of the trunk, upper body and lower body in approximately 1.5 inch increments. FIG. 1 shows a side view of the apparatus. Two bars 1 extend a total length of approximately 16 inches.

The bars 1 form a center axis for a spool or spool 2 with a rotatable inner portion 3. A double strap 51 is wound on the spool 2. The strap 51 forms a loop that can be locked to any length desired. A strap cover 50 covers the coiled strap on the spool.

Figure 2:
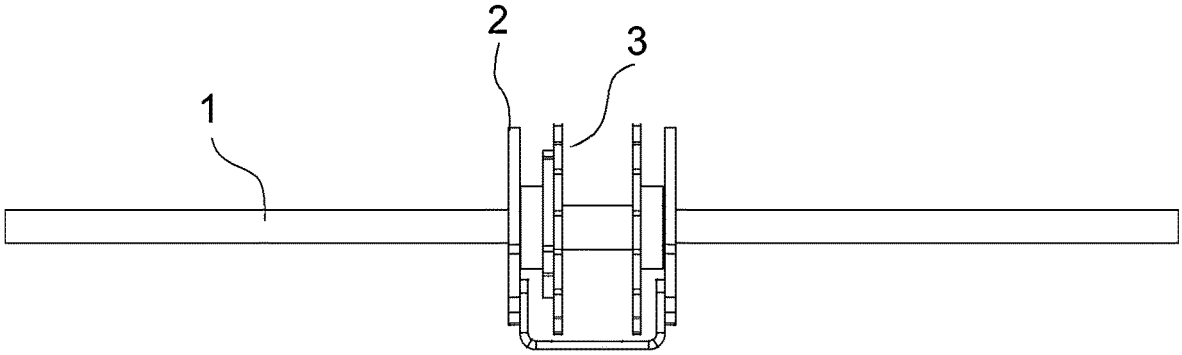
FIG. 2 shows a side view of the embodiment of FIG. 1 without the strap.

FIG. 2 shows a side view of the embodiment of FIG. 1 with the strap cover and strap removed. The bars 1, and spool 2, 3 are shown.

Construction

Figure 3C:
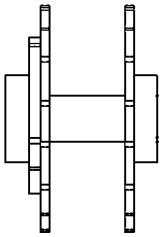
FIG. 3C is a side view of the spool of FIG. 2B.
Figure 3B:
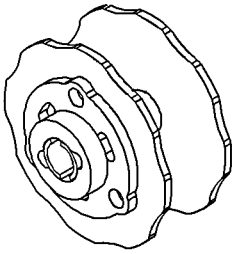
FIG. 3A shows an exploded view of an embodiment of the spool.
Figure 3A:
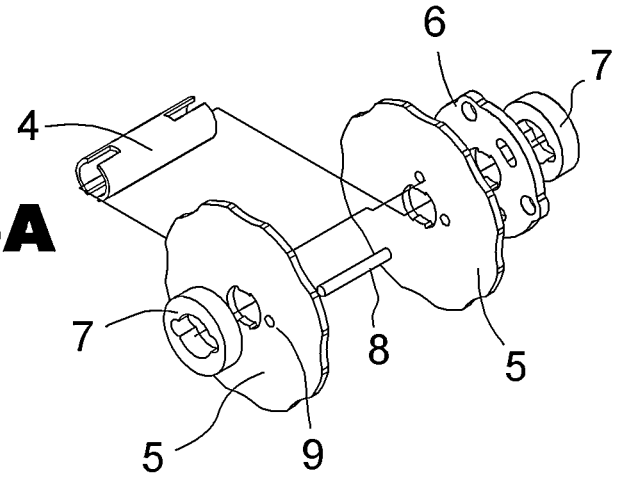

Turning to FIG. 3A, a disassembled view of the spool or drum 2 can be seen. The sleeve 4 is notched out at either end to accommodate and lock into place the two side walls 5, a locking gear 6 and two spacers 7. The two spool walls 5 slide into place onto the sleeve 4. At one end, the locking gear 6 is welded to the side wall 5. The spacer 7 is slid into notch of the sleeve 4 and welded to both the locking gear 6 and the sleeve 4 making it one solid mass.

Prior to assembling the other side, the locking pin 8 slides into holes 9 of spool walls 5. At the other end, the side wall 5 is slid into notch of the sleeve 4. The spacer, 7 slides into notch of the sleeve 4 and is welded to side wall 5 and the sleeve 4 making it one solid mass completing the spool. FIG. 3B shows an isometric view of the assembled spool, while FIG. 2C shows a side view of it.

Figure 4C:
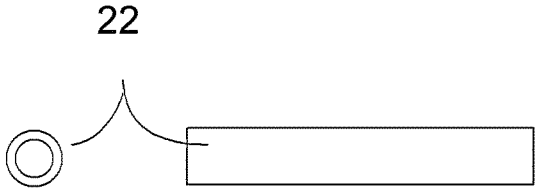
FIG. 4C shows an end and side view of the center tube.
Figure 4D:
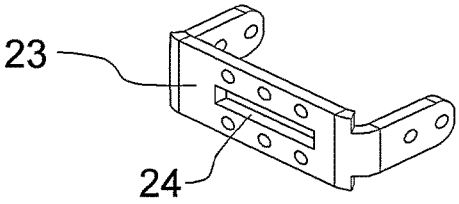
FIG. 4D shows an isometric view of a force modulating rail.
Figure 4A:
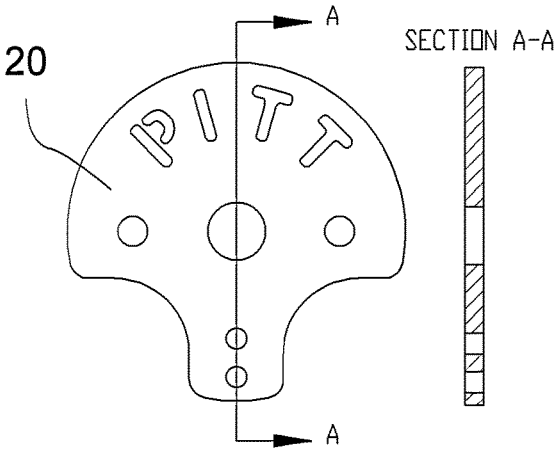
FIGS. 4A-4B show flat views and sections of the outside wall parts of the device.
Figure 4B:
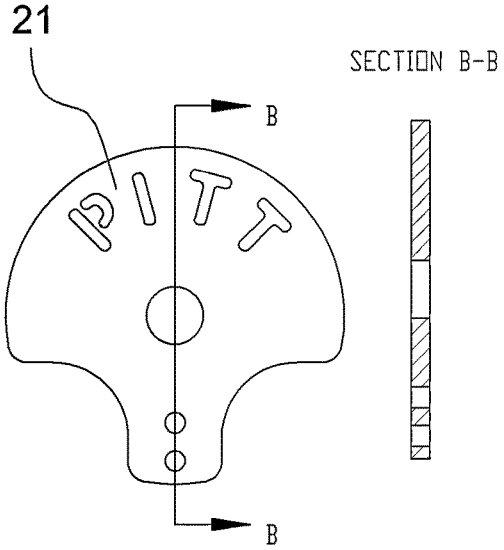

FIGS. 4A-4B show the two out outside wall parts 20, 21. FIG. 4C shows the center tube 22. FIG. 4D shows a force modulating rail. Outside wall part 20 is slid onto the center tube 22 and welded the entire circumference on the outside edge. The completed spool is placed onto the center tube 22 on the inside edge of the outside wall 20. The other outside wall 21 is slid onto the center tube 22. Prior to welding, a force modulating rail system 23 is placed on the inside edge of the outside wall parts 20, 21 ensuring proper spacing and alignment of the spool. The force modulating rail system 23 is bolted securely into place via the four holes on the outside wall part 20 and 21. Welding the circumference of the outside wall 21 concludes the construction.

Depending upon whether the unit is set-up for a left- or right-handed user, the spring-biased locking pin 8 (FIG. 3A) is aligned up with either hole on the appropriate outside wall 20. A spring is aligned with a chosen locking pin hole and placed between inside edge of outside wall part 20 and locking gear 6 (FIG. 3A) The locking pin 8 is then pushed through the length of the spring and into one of the plurality of locking holes on the locking gear 6. The preferred number of locking holes in the locking gear 6 is three. This allows approximately 1.5 inch adjustments in the length of the strap. A cotter locking pin is pushed through the hole at the end of locking pin 8, and the ends are bent locking the spring into place.

The isometric load is generated by the force initiated by the user and is transmitted through an approximately 19 ft. (folded length), approximately 1.5 in. wide seat belt grade polyester strap with a load rating of approximately 4000-6000 lbs. The strap is folded in half creating a loop for the user to stand, kneel, sit or lie down on. The ends of the strap are folded over on themselves approximately ½ in length, and the ends are then sewn together to create a "wedge" about two times wider than the strap. The strap is mounted to the spool in the space between the spool walls 5 (FIG. 3A) by passing through the ⅛ in gap created via the locking pin 8 and sleeve 4. The strap wedged in place is then spooled onto the spool and the looped end passed through the gap 24 on the force modulating rail system (FIG. 4D).

The strap casing is then placed over the strap and then affixed to the force modulating rail system with six bolts. Handles that cover the tube 22 are approximately ¾ in diameter heat shrink. They are cut to approximately 8.5 in. in length, and slid onto the outer portion of the tube 22, and affixed into place with a heat gun or other affixing means.

To operate the Portable Isometric Training Tool, the user holds the handle in either the right or left hand, and with the thumb and index finger, pulls and holds the retractable locking pin 8. The spool rotates and the strap unspools when the user pulls holding the locking pin 8 with one hand and pulling the strap with the other hand. The locking pin 8 is biased with a spring. The spool locks in place via this spring when the locking pin 8 is released, and the locking pin 8 slides into one of the plurality of locking holes on the locking gear 6 that is welded to the side of the spool wall 5 The preferred number locking holes is three; however, any number of locking holes is within the scope of the present invention. As stated, three locking holes provides approximately 1.5 inches of travel of the strap. To re-spool the strap, the user pulls and holds the locking pin 8, and using the opposite hand, turns the spool in the opposite direction rewinding the strap on the spool.

Method of Use

The present invention or device provides the user the ability to perform countless isometric exercises in a lying down, seated, kneeling or standing position. The user can perform any exercise in 1.5 inch increments with a maximum load capacity of 4000-6000 lb thereby ensuring the user can achieve their rehabilitation or fitness goals using this lightweight 6 lb portable isometric training tool. The steps outlined below are for the use of the invention for just a few of the exercises that can be performed on the device: squat, bicep curl, shoulder press and bent over row.

Squat:

- Step 1: Holding the device in your left hand, pull and hold the locking pin with thumb and index finger to release the spool.
- Step 2: Using right hand, pull the resistance strap to the desired length for a squat 3-5 ft.
- Step 3: Release locking pin so it slides into locking gear hole and ensure strap is secure.
- Step 4: Place feet inside strap loop and stand shoulder width or wider on the strap with the strap under the mid-foot or heels.
- Step 5: Place handles of the device within elbow crease.
- Step 6: Initiating movement from the legs, apply force upward driving the body toward a standing position and hold the position 5-60 sec depending the desired strength outcome.

Bicep Curl:

- Step 1: Holding the device in your left hand, pull and hold the locking pin with thumb and index finger to release the spool.
- Step 2: Using right hand, pull the resistance strap to the desired length for a bicep curl 5-6 ft.
- Step 3: Release locking pin so it slides into locking gear hole and ensure strap is secure.
- Step 4: Place feet inside strap loop and stand shoulder width or wider on the strap with the strap under the midfoot or heels.
- Step 5: Grab the handles of the device palm up and with elbows bent to approximately 90 degrees.
- Step 6: Initiating movement from the elbow, apply force upward and hold position 5-60 sec depending on the desired strength outcome.

Shoulder Press:

- Step 1: Holding the device in your left hand, pull and hold the locking pin with thumb and index finger to release the spool.
- Step 2: Using right hand, pull the resistance strap to the desired length for a shoulder press 10-12 ft.
- Step 3: Release locking pin so it slides into locking gear hole and ensure strap is secure.
- Step 4: Place feet inside strap loop and stand shoulder width or wider on the strap with the strap under the mid-foot or heels.
- Step 5: Grab the handles of the device palm down and reaching overhead with elbows bent 5-15 degrees.
- Step 6: Initiating movement from the shoulder, apply force upward and hold position 5-60 sec depending on the desired strength outcome.

Bent Over Row:

- step 1: Holding the device in your left hand, pull and hold the locking pin with thumb and index finger to release the spool.
- Step 2: Using right hand, pull the resistance strap to the desired length for a bent over row 4-5 ft.
- Step 3: Release locking pin so it slides into locking gear hole and ensure strap is secure.
- Step 4: Place feet inside strap loop and stand shoulder width on the strap with the strap under the midfoot or heels.
- Step 5: Grab the handles of the device either palm up or down and with elbows bent 80-110 degrees.
- Step 6: Initiating movement from the shoulder, apply a pulling force backward and hold position 5-60 sec depending on the desired strength outcome.

The unique benefit of this invention or device is that allows the user to safely perform countless isometric exercises with maximum effort for both the small and large muscle groups of the body in addition to being able to perform isolation (single-joint) or compound (multi-joint) exercises thereby providing the user, regardless of physical ability or limitation, the opportunity to safely and efficiently perform maximal muscular effort for countless isometric exercises in a lightweight (6 lb), compact (21 in) unit.

This present invention or device is directed to a methodology of exercise that has been scientifically validated and proven for decades to be safe, efficient and effective. Due to its preferred steel construction and "seat belt" grade polyester strap, the device was built to help users to achieve their therapeutic, fitness and performance based exercise goals. It should be noted that while steel and polyester are preferred materials, and strong material is within the scope of the present invention. Due to its ease of use and compact size, it can easily be used in a gym, clinic or home environment.

Several descriptions and illustrations have been presented to aid in understanding the present invention. One with skill in the art will realize that numerous changes and variations may be made without departing from the spirit of the invention. Each of these changes and variations is within the scope of the present invention.

I claim:

1. An isometric training device comprising:

a rotatable and lockable spool configured to contain a wrapped strap, the spool having side walls and a central axis;

a pair of elongated bars attached to the spool and extending outward from the central axis on each side, the elongated bars being configured to attach the isometric training device to a fixed surface, first and second outer walls fixedly mounted concentrically on the elongated bars with the spool being rotatably mounted concentrically on the elongated bars between the first and second outer walls; and a spring-biased retractable locking pin retractably attached to one of the first and second outer walls and which passes through a hole on that respective outer wall, wherein a length of the strap is adjustable.

2. The isometric training device of claim 1, wherein:

each side wall of the spool has a hole adapted to receive the spring biased retractable locking pin;

said retractable locking pin has an engaged position, whereby the retractable locking pin passes through at least one of the holes of one of the side walls, preventing the spool from rotating, and said retractable locking pin has a retracted position, whereby the retractable locking pin clears each of the holes of the side walls, allowing the spool to rotate.

3. The isometric training device of claim 2, further comprising a locking gear affixed to one side wall of the spool, the locking gear having three locking holes.

4. The isometric training device of claim 3, wherein the three locking holes are positioned on the spool to allow the strap to travel approximately 1.5 inches as the retractable locking pin is retracted from a first of the three locking holes, the spool is rotated, and the retractable locking pin is allowed to seat in an adjacent one of the three locking holes.

5. The isometric training device of claim 1, wherein the strap passes through a force-modulating rail.

6. The isometric training device of claim 1, wherein the locking pin is constructed to be attached to the first outer wall for left-handed operation and attached to the second outer wall for right-handed operation.

7. The isometric training device of claim 1, wherein the strap is approximately 19 feet long and has a width of approximately 1.5 inches.

8. The isometric training device of claim 1, wherein the strap is of seatbelt grade polyester with a load rating of from approximately 4000 lbs. to approximately 6000 lbs.

9. An isometric training device comprising:

a rotatable and lockable spool configured to contain a wrapped strap, the spool having side walls and a central axis;

a pair of elongated bars attached to the spool and extending outward from the central axis on each side, the elongated bars constructed to attach the device to a fixed surface;

first and second outer walls fixedly mounted concentrically on said bars with the spool being rotatably mounted concentrically on the bars between the first and second outer walls; and a spring-biased retractable locking pin retractably attached to one of the first and second outer walls and which passes through a hole in the respective outer wall, wherein:

each side wall of the spool has a hole adapted to receive the spring biased retractable locking pin, said retractable locking pin has an engaged position, whereby the retractable locking pin passes through at least one of the holes of one of the side walls, preventing the spool from rotating, and said retractable locking pin has a retracted position, whereby the retractable locking pin clears each of the holes of the side walls, allowing the spool to rotate.

10. The isometric training device of claim 9, further comprising a locking gear affixed to one side wall of the spool, the locking gear having three locking holes.

11. The isometric training device of claim 9, wherein the retractable locking pin is constructed to be attached to the first outer wall for left-handed operation and attached to the second outer wall for right-handed operation.

12. The isometric training device of claim 9, wherein the strap is approximately 19 feet long and has a width of approximately 1.5 inches.

13. The isometric training device of claim 9, wherein the strap is of seatbelt grade polyester with a load rating of from approximately 4000 lbs. to approximately 6000 lbs.

14. A method for providing an isometric training device comprising:

providing a rotatable and lockable spool configured to contain a wrapped strap, the spool having side walls and a central axis;

providing a pair of elongated bars attached to the spool and extending outward from the central axis on each side, the elongated bars constructed to attach the device to a fixed surface;

providing first and second outer walls fixedly mounted concentrically on said bars with the spool being rotatably mounted concentrically on the bars between the first and second outer walls; and providing a spring-biased retractable locking pin retractably attached to one of the first and second outer walls and which passes through a hole in the respective outer wall;

wherein:

each side wall of the spool has a hole adapted to receive the spring biased retractable locking pin, said retractable locking pin has an engaged position, whereby the retractable locking pin passes through at least one of the holes of one of the side walls, preventing the spool from rotating, and said retractable locking pin has a retracted position, whereby the retractable locking pin clears each of the holes of the side walls, allowing the spool to rotate.

15. The method of claim 14, wherein the locking pin is constructed to be attached to the first outer wall for left-handed operation and attached to the second outer wall for right-handed operation.

16. The method of claim 14, wherein the strap is approximately 19 feet long and has a width of approximately 1.5 inches.

17. The method of claim 14, wherein the strap is of seatbelt grade polyester with a load rating of from approximately 4000 lbs. to approximately 6000 lbs.

18. The method of claim 14, wherein the strap passes through a force-modulating rail.

* * * * *